United States Patent [19]

Fowler et al.

[11] 4,401,896

[45] Aug. 30, 1983

[54] WEIGHT OR AMBIENT PRESSURE-RESPONSIVE MECHANICAL PRESSURE SWITCH

[76] Inventors: Eugene W. Fowler, 816 Superba Ave., Venice, Calif. 90291; Raymond W. Fowler, 2465 Amherst Ave., Los Angeles, Calif. 90064

[21] Appl. No.: 266,714

[22] Filed: May 26, 1981

[51] Int. Cl.[3] ..... H01H 21/26; H01H 35/34

[52] U.S. Cl. ..... 307/118; 361/188; 340/666; 200/85 R; 200/86 R; 200/83 Z

[58] Field of Search ..... 307/118, 144; 361/170, 361/188; 340/573, 565, 626, 666; 200/85 R, 86 R, 86 A, 86.5, 81 R, 83 R, 83 B, 83 N, 83 Y, 83 W, 83 Z, 159 B, 333

[56] References Cited

U.S. PATENT DOCUMENTS

| | | | |
|---|---|---|---|
| 2,780,693 | 2/1957 | McClellan | 200/86 R |
| 3,048,748 | 8/1962 | Carey | 361/170 |
| 3,209,089 | 9/1965 | Weissburg | 200/83 N |
| 3,662,229 | 5/1972 | Graff | 361/388 |
| 3,723,684 | 3/1973 | Greenwood | 200/83 N |
| 3,830,991 | 8/1974 | Durocher | 200/86 R |
| 3,920,940 | 11/1975 | Brown | 200/85 R |
| 4,086,458 | 4/1978 | Dickey | 200/85 R |
| 4,090,045 | 5/1978 | Marsh | 200/86 R |
| 4,126,856 | 11/1978 | Gray | 340/666 |
| 4,175,263 | 11/1979 | Triplett | 340/666 |

FOREIGN PATENT DOCUMENTS

| | | | |
|---|---|---|---|
| 2431178 | 2/1980 | France | 200/83 Z |

*Primary Examiner*—G. P. Tolin

*Attorney, Agent, or Firm*—Daniel Jay Tick

[57] ABSTRACT

An electrically non-conductive separator having a hole formed therethrough is interposed between a pair of switch contacts having a modulus of elasticity. A cover of electrically non-conductive flexible material covers the switch contacts. Electrically conductive leads are electrically connected to, and extend from, the switch contacts. The positions of the switch contacts relative to each other are determined by differences in pressure and control the operation of an electrical circuit electrically connected to the leads to operate a circuit to perform a function.

17 Claims, 6 Drawing Figures

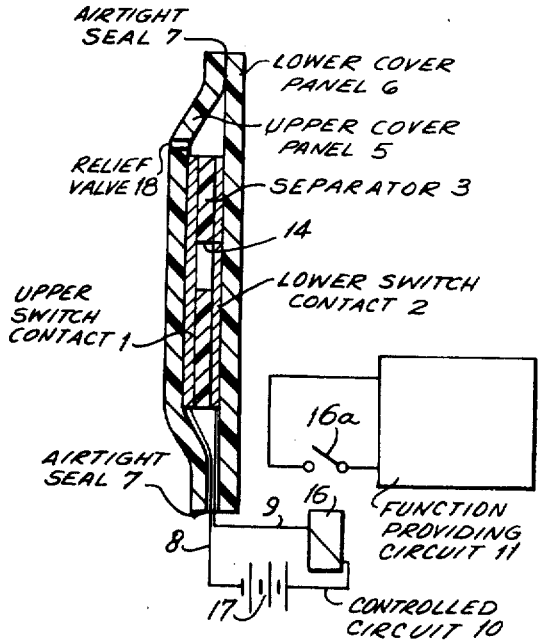

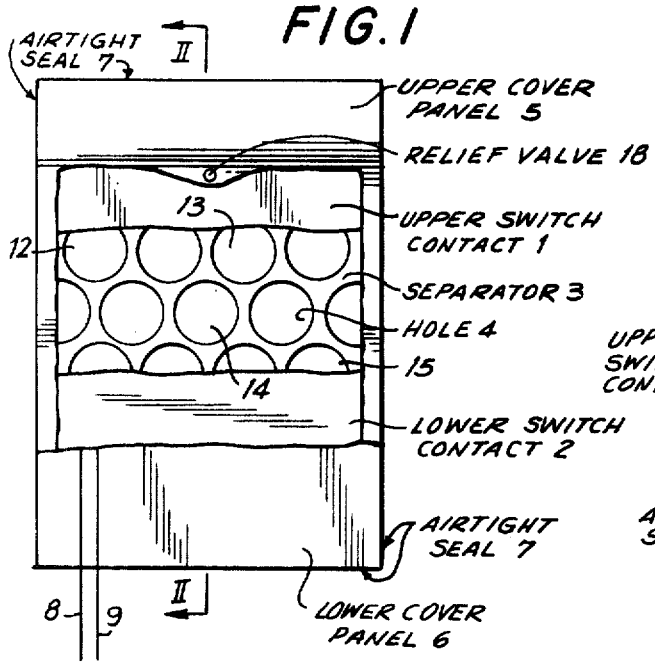
FIG. 1
AIRTIGHT SEAL 7
II
UPPER COVER PANEL 5
RELIEF VALVE 18
13
UPPER SWITCH CONTACT 1
12
SEPARATOR 3
HOLE 4
15
14
LOWER SWITCH CONTACT 2
AIRTIGHT SEAL 7
8
9
II
LOWER COVER PANEL 6

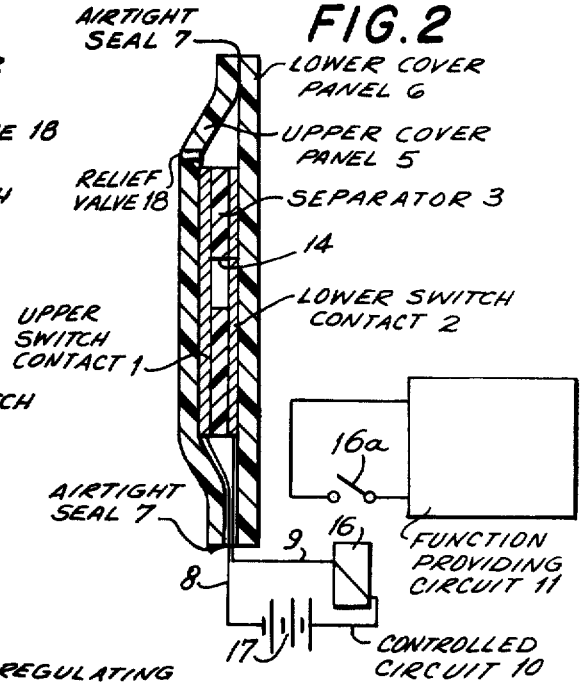
FIG. 2
AIRTIGHT SEAL 7
LOWER COVER PANEL 6
UPPER COVER PANEL 5
RELIEF VALVE 18
SEPARATOR 3
14
LOWER SWITCH CONTACT 2
UPPER SWITCH CONTACT 1
16a
AIRTIGHT SEAL 7
9
16
FUNCTION PROVIDING CIRCUIT 11
8
17
CONTROLLED CIRCUIT 10

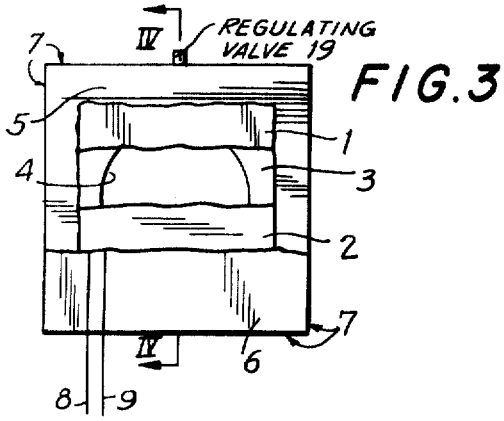
IV
REGULATING VALVE 19
7
FIG. 3
5
1
4
3
2
7
IV
6
8
9

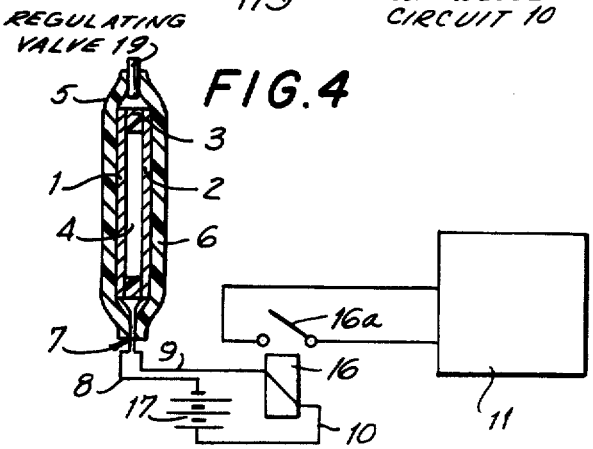
REGULATING VALVE 19
FIG. 4
5
3
1
2
4
6
16a
7
9
16
8
17
10
11

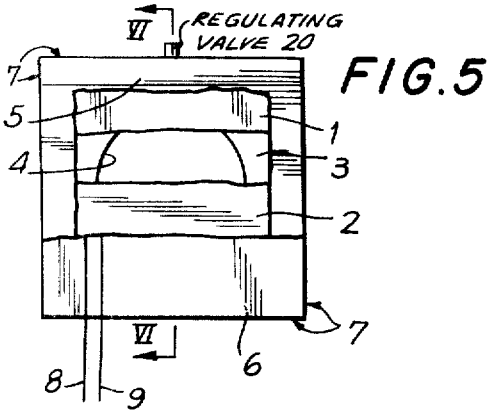
VI
REGULATING VALVE 20
7
FIG. 5
5
1
4
3
2
7
VI
6
8
9

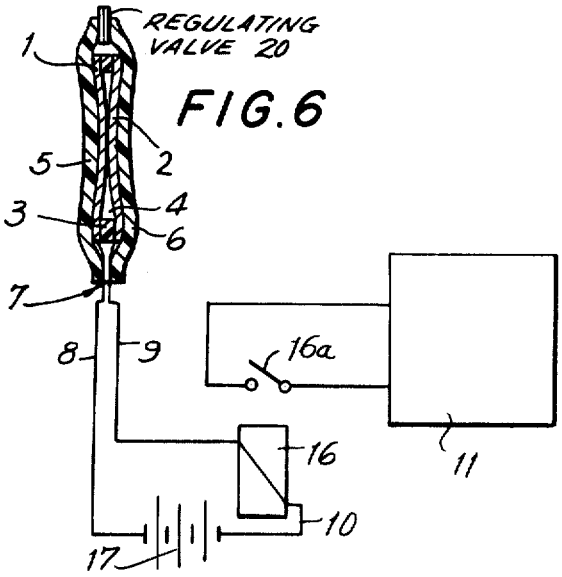
REGULATING VALVE 20
1
FIG. 6
5
2
3
4
6
7
8
9
16a
16
11
10
17

WEIGHT OR AMBIENT PRESSURE-RESPONSIVE MECHANICAL PRESSURE SWITCH

BACKGROUND OF THE INVENTION

The present invention relates to a pressure switch. More particularly, the invention relates to a pressure switch which responds to the weight of a person or object or to a difference in ambient pressure.

There are many situations, industrial, as well as residential, where a switch response to a difference in pressure or gravitational force is essential. Thus, for example, a switch which reacts to the weight of a person or object is a necessary part of many burglar alarm systems, traffic control systems, door opening systems for garages, warehouses, and the like, and so on. Furthermore, there are many industrial, commercial and military situations in which it is necessary to provide an indication or warning of a decrease or an increase in atmospheric pressure, the pressure of a stored gas, or the pressure of a body of water or stored liquid.

U.S. Pat. No. 2,780,693, issued to McClellan on Feb. 5, 1957, discloses a pressure switch having a body of compressible material with conducting sheets of foraminous material at opposite surfaces thereof. Electrically conductive fasteners are provided at spaced points of the body. Each fastener is normally spaced from both the upper and lower conductive sheets, but may extend through either of such sheets. The upper and lower sheets are connected to the electrical conductors so that engagement between one or more of the fasteners with both sheets completes a circuit. The switch has an upper protective sheet of hard and stiff material and a similar lower sheet. The edges of the sheets are spaced about the structure by spacers. If the spacers consist of hard, incompressible material, the upper protective sheet is somewhat flexible, so that under the weight of a wheel of a vehicle, it is moved downward to cause electrical contact between one or more of the fasteners with both electrically conductive sheets. If, alternatively, the spacers consist of compressible material, the upper protective sheet is not essential. The operation of the McClellan switch does not depend solely upon the flexibility of the upper protective sheet, but upon the compressibility and resilience of the body of compressible material between the upper and lower electrically conductive sheets.

The principal object of the invention is to provide a pressure switch which functions efficiently, effectively and reliably to indicate a difference in pressure.

An object of this invention is to provide a pressure switch of simple structure and great durability for indicating a difference in pressure and performing a function in response to such difference.

Another object of the invention is to provide a pressure switch having very few working parts, which parts may be readily standardized, for responding to a difference in pressure efficiently, effectively and reliably.

Still another object of the invention is to provide a mat switch of simple structure which reacts efficiently, effectively and reliably to pressure exerted by a person or object on such mat.

Yet another object of the invention is to provide a mat switch of simple structure, having very few parts, which is inexpensive in manufacture, and reliably responds to the weight of a person or object thereon.

Another object of the invention is to provide a depth switch of simple structure which reacts efficiently, effectively and reliably to an increase in ambient pressure thereon and is especially suitable for determining the submersion of a submarine vessel to a depth beyond a predetermined depth and the storage of a predetermined magnitude of gas or liquid.

Still another object of the invention is to provide a depth switch of simple structure, having very few parts, which is inexpensive in manufacture, and reliably responds to an increase in pressure thereon beyond a predetermined point.

Yet another object of the invention is to provide a barometric switch of simple structure which reacts efficiently, effectively and reliably to a decrease in ambient pressure thereon and is especially suitable for determining the altitude of an aircraft higher than a predetermined point, altitude in general, and imminent change in weather conditions and the decrease in volume of a stored gas or liquid to a level less than a predetermined one.

Another object of the invention is to provide a barometric switch of simple structure, having very few parts, which is inexpensive in manufacture, and reliably responds to a decrease in pressure thereon beyond a predetermined point.

The mat switch of the invention is placed at any desired location and may be hidden under a carpet, in entry areas, hallways, stairways, or other passages, and may be placed in any area desired to be protected without the knowledge of an intruder, or traversed by people or vehicles in order to provide a desired function such as, for example, the opening of a door. The mat switch may be used to actuate an alarm, buzzer, light, or the like, open and close a door, and so on, to warn of the presence of a person or object.

The depth switch of the invention may be made of any desired thickness, shape or size and may be made wafer thin and indicates a difference in liquid depth pressure, stored liquid or gas pressure, or the like. The depth switch may be used to open or close a pressure regulating, or other type of, valve, and to actuate an alarm, buzzer, light, or the like, to warn of too great a pressure.

The barometric switch of the invention may be of any desired thickness, shape or size, and may be made wafer thin. The barometric switch may be used to operate a fan, open or close a louver, vent, shutter, or the like, to protect a structure from an approaching storm, to open vents in a greenhouse when the weather is fair, and to actuate an alarm, buzzer, light, or the like, to warn of the approach of bad weather.

BRIEF SUMMARY OF THE INVENTION

In accordance with the invention, a pressure switch for performing a function when subjected to a difference in pressure comprises a pair of superimposed electrically conductive switch contacts having a modulus of elasticity. An electrically non-conductive separator is interposed between the pair of switch contacts and has a hole formed therethrough. A cover of electrically non-conductive flexible material covers the switch contacts. Electrically conductive leads are electrically connected to, and extend from, the switch contacts, whereby the positions of the switch contacts relative to each other are determined by differences in pressure and control the operation of an electrical circuit electrically connected to the leads to operate a circuit to perform a function.

The switch contacts may comprise a pair of plates.

The switch contacts may comprise a pair of wire screens.

The switch contacts may comprise a plate and a wire screen.

In a first embodiment of the switch, the cover comprises a mat and the switch contacts are pressed together into electrical contact with each other, through the hole, by pressure exerted by a person or object on the mat.

The separator has a plurality of holes formed therethrough and the switch contacts are pressed into electrical contact with each other through the holes.

The switch contacts are normally spaced from each other and close the electrical circuit when pressed into electrical contact with each other to energize the electrical circuit.

The switch contacts are returned to spaced relation with each other, due to the elasticity of the switch contacts, when pressure exerted by a person or object on the mat is removed.

The electrical current includes a relay control winding and a source of electrical energy electrically connected in series circuit arrangement with the electrically conductive leads. The circuit includes a relay contact arm which is normally open and is closed when the relay control winding is energized by the source of electrical energy due to the switch contacts being pressed into electrical contact with each other.

The cover is a substantially airtight enclosure. A relief valve is provided in the cover for equalizing the pressure of air therein with the ambient air pressure.

In a second embodiment of the switch, the switch contacts are pressed together into electrical contact with each other, through the hole, by an increase in ambient pressure on the cover.

The switch contacts are normally spaced from each other and close the electrical circuit when pressed into electrical contact with each other to energize the electrical circuit.

The switch contacts are returned to spaced relation with each other, due to the elasticity of the switch contacts, when an increase in pressure exerted by one of the atmosphere, a gas and a liquid on the cover is removed.

The electrical circuit includes a relay control winding and a source of electrical energy electrically connected in series circuit arrangement with the electrically conductive leads. The circuit includes a relay contact arm which is normally open and is closed when the relay control winding is energized by the source of electrical energy due to the switch contacts being pressed into electrical contact with each other.

The cover is a substantially airtight enclosure. A regulating valve is provided in the cover for maintaining the pressure of air therein at a predetermined constant magnitude.

The separator has a thickness, and the modulus of elasticity of the switch contacts, the thickness of the separator and the size of the hole are provided in a ratio which causes the switch contacts to be pressed into electrical contact with each other when the pressure exerted on the cover exceeds a predetermined magnitude.

In a third embodiment of the switch, the switch contacts are moved into spaced relation with each other by a decrease in ambient pressure on the cover.

The switch contacts are normally in electrical contact with each other and open the electrical circuit when moved into spaced relation with each other to deenergize the electrical circuit.

The switch contacts are returned to electrical contact with each other, due to the elasticity of the switch contacts, when a decrease in pressure on the cover is removed.

The electrical circuit includes a relay control winding and a source of electrical energy electrically connected in series circuit arrangement with the electrically conductive leads. The circuit includes a relay contact arm which is normally open and is closed when the relay winding is deenergized due to the switch contacts being moved out of electrical contact with each other.

The cover is a substantially airtight enclosure. A regulating valve in the cover maintains a partial vacuum therein.

The separator has a thickness, and the modulus of elasticity of the switch contacts, the thickness of the separator, the size of the hole and the magnitude of the partial vacuum are provided in a ratio which causes the switch contacts to be moved into spaced relation with each other when the pressure exerted on the cover decreases below a predetermined magnitude.

BRIEF DESCRIPTION OF THE DRAWINGS

In order that the invention may be readily carried into effect, it will now be described with reference to the accompanying drawings, wherein:

FIG. 1 is a cutaway view of a first embodiment of the pressure switch of the invention;

FIG. 2 is a cross-sectional view, taken along the lines II—II, of FIG. 1, and including a schematic block representation of an electrical circuit and a function-performing circuit;

FIG. 3 is a cutaway view of a second embodiment of the pressure switch of the invention;

FIG. 4 is a cross-sectional view, taken along the lines IV—IV, of FIG. 3, and including a schematic block representation of an electrical circuit and a function-performing circuit;

FIG. 5 is a cutaway view of a third embodiment of the pressure switch of the invention; and FIG. 6 is a cross-sectional view, taken along the lines VI—VI, of FIG. 5, and including a schematic block representation of an electrical circuit and a function-performing circuit.

DETAILED DESCRIPTION OF THE INVENTION

The pressure switch of the invention performs a function when subjected to a difference in pressure. The pressure switch of the invention comprises a pair of superimposed electrically conductive switch contacts 1 and 2 (FIGS. 1 to 6) having a modulus of elasticity or resiliency. An electrically non-conductive separator 3 is interposed between the pair of switch contacts 1 and 2, as shown in FIGS. 1 to 6. The switch contacts 1 and 2 may comprise any suitable electrically conductive material having elastic or resilient properties such as, for example, steel, steel alloy, or the like. The separator 3 may comprise any suitable electrically non-conductive dielectric or insulative material such as, for example, laminated phenolic, plastic, rubber, or the like, and has a hole 4 formed therethrough (FIGS. 1 to 6).

A cover of electrically non-conductive flexible material such as, for example, rubber, synthetic rubber, or a durable, resilient or flexible plastic of any suitable type, encloses the switch contacts 1 and 2 in a substantially airtight manner. The cover has an upper panel 5 and a lower panel 6 (FIGS. 1 to 6) joined by any suitable means such as, for example, thermal welding, to form a hermetic seal 7 (FIGS. 1 to 6) at all the edges of said upper and lower panels.

Electrically conductive leads 8 and 9 are electrically connected to, and extend from, the switch contacts 1 and 2, respectively, as shown in FIGS. 1 to 6. Thus, the positions of the switch contacts 1 and 2 relative to each other are determined by differences in pressure and control the operation of an electrical circuit 10, electrically connected to the leads 8 and 9 (FIGS. 2, 4 and 6) to operate a function providing circuit 11 (FIGS. 2, 4 and 6) to perform a function.

In each of the three embodiments of the invention, both the upper and lower switch contacts 1 and 2, respectively, may comprise an electrically conductive plate or an electrically conductive wire screen such as, for example, spring steel wire mesh. In each of the three embodiments of the invention, the upper switch contact 1 may comprise an electrically conductive plate and the lower switch contact 2 may comprise an electrically conductive wire screen, or vice versa.

The first embodiment of the pressure switch of the invention, shown in FIGS. 1 and 2, is a mat switch. The separator 3 has a plurality of holes 12, 13, 14, 15, and so on, formed therethrough, as shown in FIG. 1. The upper and lower switch contacts 1 and 2, respectively, of the embodiment of FIGS. 1 and 2 are pressed into electrical contact with each other, through the holes 4, 12 to 15, and so on, by pressure exerted by a person or object on the mat or cover 5, 6.

In the mat switch of FIGS. 1 and 2, the switch contacts 1 and 2 are normally spaced from each other, as shown in FIG. 2. The switch contacts 1 and 2 close the electrical or controlled circuit 10 (FIG. 2) when they are pressed into electrical contact with each other. This results in the energization of the controlled circuit 10, since said circuit includes a relay control winding 16 and a source of electrical energy of any suitable type such as, for example, a battery 17 or a commercial power source, connected in series circuit arrangement with the electrically conductive leads 8 and 9, as shown in FIGS. 2, 4 and 6.

The function providing circuit includes a relay contact arm 16*a*, which is normally open, as shown in FIG. 2, and is closed by the relay control winding 16 when said relay control winding is energized by the source of electrical energy 17 due to the switch contacts 1 and 2 being pressed into electrical contact with each other.

The switch contacts 1 and 2 are returned to spaced relation with each other, as shown in FIG. 2, due to the elasticity or resiliency of said switch contacts, when pressure exerted by a person or object on the mat is removed.

A relief valve 18 (FIG. 2) of any suitable type is provided in the upper cover panel 5 for equalizing the pressure of air in the mat switch with the ambient air pressure.

The mat switch of FIGS. 1 and 2 is a built-in weight-force switch, enclosed by the mat or cover 5, 6. The mat switch transmits an electric current through the leads 8 and 9 when an object such as, for example, a vehicle, is on it or a person steps on it. The weight or gravitational force of the object or person closes the switch contacts 1 and 2 of the mat weight-force switch and the electrical current is used to close the function providing circuit 11 to provide a function such as, for example, to operate an electric motor to perform a special operation such as, for example, to open and close a door or gate. The closed function providing circuit 11 may also be used to operate an electric motor to perform other operations for convenience, or to actuate an alarm, buzzer, light, or the like. When the specific operation or function has been accomplished, the mat switch is turned off, after the weight or pressure is lifted therefrom. The mat switch then resets itself to its original ON or alert condition so that it may be actuated when the next situation arises and may perform, again and again, in the same manner as before.

The separator 3 is sandwiched between switch contacts 1 and 2, and the holes 4, 12 to 15, and so on, are variable in size and shape, for different applications of the mat, to provide sensitivity to the pressure, gravity force or weight required for closing said contacts of the mat switch.

The mat switch may be of any thickness, and is made very thin when used under rugs in entry areas, entry halls, stairways, or any area in which the mat must be hidden from view. When the mat switch must be strong, in order to bear the weight of a motor vehicle, it may be of any thickness, shape or size according to its desired application. The mat switch is applicable to industrial, as well as residential alarm systems, and is used for different purposes and all types of operations. The mat switch is not difficult to construct, since it has only seven working parts, and is therefore very reliable in performance and durability. This also facilitates the standardization of all parts of the mat switch for simple application and operation.

The pressure switch of the second embodiment of the invention, shown in FIGS. 3 and 4, functions as a depth switch. The switch contacts 1 and 2 are pressed together into electrical contact with each other, through the hole 4, by an increase in ambient pressure on the cover 5, 6. The switch contacts 1 and 2 are normally spaced from each other, as shown in FIG. 4, and close the controlled circuit 10, when pressed into electrical contact with each other to energize said electrical circuit, in the same manner as the embodiment of FIGS. 1 and 2.

The switch contacts 1 and 2 are returned to spaced relation with each other, and therefore out of electrical contact, due to the elasticity or resiliency of said switch contacts, when an increase in pressure exerted by the atmosphere, a gas or a liquid on the cover 5, 6 is removed.

In the embodiment of FIGS. 3 and 4, a regulating valve 19 of any suitable type is provided in the cover 5, 6, as shown in FIGS. 3 and 4. The regulating valve 19 functions to maintain the pressure of air in the depth switch at a predetermined constant magnitude.

In the depth switch of FIGS. 3 and 4, the separator 3 is provided with a predetermined thickness and the modulus of elasticity or resiliency of the switch contacts 1 and 2 and said thickness are provided in a ratio which causes said switch contacts to be pressed into electrical contact with each other when the pressure exerted on the cover 5, 6 exceeds a predetermined magnitude.

The regulating valve 19 is used to manually regulate and maintain a required volume of air inside the cover 5, 6, sealed in for the desired predetermined function or functions. This maintains the proper balance of air within the cover 5, 6 relative to the ratio of the thickness of the switch contacts 1 and 2, the thickness of the separator 3 and the size of the hole 4 through said separator, so that said switch contacts make electrical contact with each other when the outside pressure, stored liquid or gas, or liquid depth required for moving said switch contacts into contact with each other is reached.

The normally open depth switch is turned ON when the ambient pressure is increased, and is turned OFF when the ambient pressure is decreased. The depth switch causes the flow of an electric current through the electric circuit 10 when a predetermined ambient pressure is reached. The pressure of a stored liquid or gas, or the depth of a liquid, or any predetermined pressure, closes the switch contacts 1 and 2 of the depth switch and the electrical current flowing through the controlled circuit 10 causes a current flow through the function providing circuit 11, so that said circuit 11 provides a function such as, for example, the operation of an electric motor. The electric motor, in turn, may perform a desired function such as, for example, the opening or closing of a valve, such as, for example, a pressure regulating valve, and may, for example, secure functioning parts of a submersible object and/or a sinking ship, such as, for example, doors, hatches, portholes, and so on, and will automatically start a bilge pump when the programmed pressure is attained. The current may also actuate an alarm, buzzer, light, or the like, and may release a parachute from a descending object and may perform automatically programmed descending pressure functions after re-entry of a vehicle into the atmosphere. The current may also provide a warning when a capacitor or other electrical equipment containing PCB or polychlorinated biphenyl is about to explode due to an increase in internal pressure and may automatically switch in an electrical bypass circuit to prevent such explosion and thereby prevent the ensuing dangerous pollution and contamination.

The depth switch may be made of any desired thickness, shape or size, and may be made wafer thin, in accordance with the mathematical requirements dependent upon the desired application and operation of said switch. The depth switch indicates a difference in pressure such as, for example, liquid depth pressure, stored liquid or gas pressure, ambient air pressure, or the like. A plurality of depth switches may be connected in parallel to a panel having different colored lights to indicate changes in pressure as they occur, and sound an alarm when the pressure of the stored liquid or gas becomes too great or the depth of the submersible vessel carrying the depth switch is too great.

The pressure switch of the third embodiment of the invention, shown in FIGS. 5 and 6, functions as a barometric or altitude switch. The switch contacts 1 and 2 are moved into spaced relation with each other by a decrease in ambient pressure on the cover 5, 6. The switch contacts 1 and 2 of the embodiment of FIGS. 5 and 6 are normally in electrical contact with each other, as shown in FIG. 6. The switch contacts 1 and 2 open the controlled circuit 10 when moved into spaced relation with each other, so that they are out of electrical contact, to deenergize said circuit.

The switch contacts 1 and 2 of the embodiment of FIGS. 5 and 6 are returned to electrical contact with each other, due to the elasticity or resilience of said switch contacts, when a decrease in pressure on the cover 5, 6 is removed.

The relay arm 16*a* of the function providing circuit 11 is normally open, as shown in FIG. 6, due to the energized condition of the relay control winding 16, and is closed when said relay control winding is deenergized due to the switch contacts 1 and 2 being moved out of electrical contact with each other.

In the embodiment of FIGS. 5 and 6, a regulating valve 20 of any suitable type is provided in the cover 5, 6, as shown in FIGS. 5 and 6. The regulating valve 20 functions to maintain a partial vacuum in the barometric switch.

In the barometric switch of FIGS. 5 and 6, the separator 3 is provided with a predetermined thickness. The modulus of elasticity or resiliency of the switch contacts 1 and 2, the thickness of the separator 3 and the magnitude of the partial vacuum are provided in a ratio which causes said switch contacts to be moved into spaced relation with each other when the pressure exerted on the cover 5, 6 decreases below a predetermined magnitude.

The regulating valve 20 is used to manually regulate and maintain a required partial vacuum within the barometric switch. The partial vacuum maintains the switch contacts 1 and 2 closed for the proposed predetermined function or functions. This maintains the proper balance of the partial vacuum within the cover 5, 6 to maintain the switch contacts 1 and 2 normally closed and to maintain the ratio of the thickness of said switch contacts, the thickness of the separator 3 and the size of the hole 4 through said separator, so that said contacts are opened when the ambient atmospheric pressure decreases.

The barometric switch is normally closed or ON, so that the relay control winding 16 is normally energized and maintains the function providing circuit 11 open, as shown in FIG. 6. When the switch contacts 1 and 2 are open-circuited by a decrease in the ambient atmospheric pressure to a predetermined extent, the relay control winding 16 is deenergized and permits the relay contact arm 16*a* to close, thereby closing the function providing circuit 11, when the ambient pressure decreases or when the atmospheric pressure falls to a predetermined level, thereby warning of an approaching storm. When the atmospheric pressure increases or rises, the barometric switch is turned ON by the movement of the switch contacts 1 and 2 into electrical contact, so that the switch is ready to respond to a decrease in pressure.

When the normally closed barometric switch is opened or turned OFF, due to a decrease in ambient pressure, the relay control winding 16 is deenergized and permits the relay contact arm 16*a* to close, so that the function providing circuit 11 is closed and provides a function such as, for example, the actuation and operation of an electric motor to perform a special operation such as, for example, the operation of a fan or the opening or closing of a louver, vent, shutter, or the like, to protect a structure from an approaching storm, or to open vents in a greenhouse when the weather is fair. The electric motor may also perform other operations for convenience, or actuate an alarm, buzzer, light, or the like, to indicate an impending approach of a storm such as, for example, to warn of the approach of a tornado while it is still breeding and before the tornado becomes active.

The barometric switch may be utilized to ignite a rocket-powered vehicle at a predetermined programmed altitude.

A plurality of the barometric switches may be connected in parallel to a panel of different colored lights to indicate different barometric changes as they occur, and to sound an alarm when there is danger of an impending storm. The barometric switches energize lights of different colors on the panel to indicate the different barometric changes of the weather as they occur when the barometric pressure decreases. The lights are deenergized when the pressure increases beyond a predetermined level.

The barometric switch may be made of any desired thickness, shape or size, and may be made wafer thin in accordance with the mathematical requirements dependent upon the desired application and operation of said switch.

The mat switch, depth switch and barometric switch of the invention are not difficult to construct, since each switch has only eight working parts. The small number of working parts also makes the switches of the invention very reliable in performance and durability. It also facilitates the standardization of all parts of the switches for simple application and operation.

While the invention has been described by means of specific examples and in specific embodiments, we do not wish to be limited thereto, for obvious modifications will occur to those skilled in the art without departing from the spirit and scope of the invention.

We claim:

1. A pressure switch for performing a function when subjected to a difference in pressure, said pressure switch comprising a pair of superimposed electrically conductive switch contacts having a modulus of elasticity;

electrically non-conductive separating means interposed between the pair of switch contacts, said separating means having a hole formed therethrough;

a cover of electrically non-conductive flexible material covering said switch contacts whereby said switch contacts are pressed together into electrical contact with each other, through said hole, by pressure exerted on said cover and are moved into spaced relation with each other by a decrease in pressure on said cover, said cover forming a substantially airtight enclosure;

a relief valve in said cover for equalizing the pressure of air therein with the ambient air pressure; and electrically conductive leads electrically connected to, and extending from, said switch contacts, whereby the positions of said switch contacts relative to each other are determined by differences in pressure and control the operation of an electrical circuit electrically connected to said leads to operate a circuit to perform a function.

2. A pressure switch as claimed in claim 1, wherein said switch contacts comprise a pair of plates.

3. A pressure switch as claimed in claim 1, wherein said switch contacts comprise a pair of wire screens.

4. A pressure switch as claimed in claim 1, wherein said switch contacts comprise a plate and a wire screen.

5. A pressure switch as claimed in claim 1, wherein said cover comprises a mat.

6. A pressure switch as claimed in claim 1, wherein said switch contacts are pressed together into electrical contact with each other, through said hole, by an increase in ambient pressure on said cover and are moved into spaced relation with each other by a decrease in ambient pressure on said cover.

7. A pressure switch as claimed in claim 1, wherein said separating means has a plurality of holes formed therethrough and said switch contacts are pressed into electrical contact with each other through said holes.

8. A pressure switch as claimed in claim 1, wherein said switch contacts are normally spaced from each other and close said electrical circuit when pressed into electrical contact with each other to energize said electrical circuit and said switch contacts are returned to spaced relation with each other, due to the elasticity of said switch contacts, when pressure on said cover is removed.

9. A pressure switch as claimed in claim 1, wherein said electrical circuit includes a relay control winding and a source of electrical energy electrically connected in series circuit arrangement with said electrically conductive leads and said circuit includes a relay contact arm which is normally open and is closed when said relay control winding is energized by said source of electrical energy due to said switch contacts being pressed into electrical contact with each other.

10. A pressure switch as claimed in claim 6, wherein said switch contacts are normally spaced from each other and close said electrical circuit when pressed into electrical contact with each other to energize said electrical circuit and said switch contacts are returned to spaced relation with each other, due to the elasticity of said switch contacts, when an increase in pressure exerted by one of the atmosphere, a gas and a liquid on said cover is removed.

11. A pressure switch as claimed in claim 6, wherein said electrical circuit includes a relay control winding and a source of electrical energy electrically connected in series circuit arrangement with said electrically conductive leads and said circuit includes a relay contact arm which is normally open and is closed when said relay control winding is energized by said source of electrical energy due to said switch contacts being pressed into electrical contact with each other.

12. A pressure switch as claimed in claim 1, wherein said regulating valve is for maintaining the pressure of air in said cover at a predetermined constant magnitude.

13. A pressure switch as claimed in claim 6, wherein said separating means has a thickness, and the modulus of elasticity of said switch contacts, the thickness of said separating means and the size of said hole are provided in a ratio which causes said switch contacts to be pressed into electrical contact with each other when the pressure exerted on said cover exceeds a predetermined magnitude.

14. A pressure switch as claimed in claim 6, wherein said switch contacts are normally in electrical contact with each other, open said electrical circuit when moved into spaced relation with each other to deenergize said electric circuit and are returned to electrical contact with each other, due to the elasticity of said switch contacts, when a decrease in pressure on said cover is removed.

15. A pressure switch as claimed in claim 6, wherein said regulating valve is for maintaining a partial vacuum in said cover.

16. A pressure switch as claimed in claim 15, wherein said separating means has a thickness, and the modulus of elasticity of said switch contacts, the thickness of said separating means, the size of said hole and the magnitude of said partial vacuum are provided in a ratio which causes said switch contacts to be moved into spaced relation with each other when the pressure exerted on said cover decreases below a predetermined magnitude.

17. A pressure switch as claimed in claim 6, wherein said electrical circuit includes a relay control winding and a source of electrical energy electrically connected in series circuit arrangement with said electrically conductive leads and said circuit includes a relay contact arm which is normally open and is closed when said relay control winding is deenergized due to said switch contacts being moved out of electrical contact with each other.

* * * * *